US005848570A

United States Patent [19]

Koppelkamm et al.

[11] Patent Number: 5,848,570

[45] Date of Patent: Dec. 15, 1998

[54] INKING APPARATUS FOR ROTARY PRINTING MACHINES

[75] Inventors: Günter Koppelkamm, Neuensalz; Dieter Wagner, Neundorf; Bernd Hennig, Plauen, all of Germany

[73] Assignee: MAN Roland Druckmaschinen AG, Offenbach am Main, Germany

[21] Appl. No.: 899,929

[22] Filed: Jul. 24, 1997

[30] Foreign Application Priority Data

Jul. 24, 1996 [DE] Germany ..... 196 29 811.3

[51] Int. Cl.[6] ..... B41F 31/06; B41F 31/36

[52] U.S. Cl. ..... 101/351.3

[58] Field of Search ..... 101/350.1, 350.3, 101/351.1, 351.3, 351.4, 352.01, 352.04, 352.05, 352.09, 355, 356, 357, 360, 361, 362, 363, 364, 365, 207, 208, 209; 118/259, 261

[56] References Cited

U.S. PATENT DOCUMENTS

| | | | |
|---|---|---|---|
| 2,514,556 | 7/1950 | Peyrebrune et al. . | |
| 3,921,525 | 11/1975 | D'Amato et al. | 101/365 |
| 4,155,303 | 5/1979 | Johnston | 101/363 |
| 4,357,872 | 11/1982 | Simeth et al. | 101/363 |
| 4,481,883 | 11/1984 | Savart et al. | 101/363 |
| 4,617,865 | 10/1986 | Switall | 101/350 |
| 5,081,928 | 1/1992 | Harrison | 101/351 |

FOREIGN PATENT DOCUMENTS

| | | |
|---|---|---|
| 0 422 350 A2 | 4/1991 | European Pat. Off. . |
| 26 29 331 | 1/1978 | Germany . |
| 33 08 991 | 12/1983 | Germany . |
| 34 00 831 | 7/1985 | Germany . |
| 42 24 775 | 12/1992 | Germany . |
| 42 24 775 A1 | 12/1992 | Germany . |

*Primary Examiner*—J. Reed Fisher

*Attorney, Agent, or Firm*—Cohen, Pontani, Lieberman & Pavane

[57] ABSTRACT

An inking apparatus for rotary printing machines includes a rotatably mounted, drivable ink roller and at least one ink container mounted such that it can be swivelled away from the roller, favoring cleaning and ink change. The swivelably mounted ink container permits the ink container to be emptied in an operator-friendly fashion avoiding ink residues to the greatest possible extent and also permits thorough cleaning of the ink container and the roller with good accessibility. The roller is mounted in a separate holder and the holder is mounted in the frame in such a way as to be swivelable separately from as well as together with the ink container.

25 Claims, 9 Drawing Sheets

INKING APPARATUS FOR ROTARY PRINTING MACHINES

BACKGROUND OF THE INVENTION

1. Field of the Invention

The present invention relates to an inking apparatus for rotary printing machines. More specifically, the present invention relates to a mechanism which enables easy access to an ink container in an inking apparatus for rotary printing machines for changing ink and for cleaning the ink container.

2. Description of the Related Art

A German reference DE AS 26 29 331 discloses an inking apparatus with an ink ductor roller that is rotatably mounted in the frame. The inking apparatus further includes an ink reservoir in the form of an ink well that is swivelably mounted such that it swivels away from the ductor roller.

Another German reference DE 42 24 775 A1 describes an analogous device, in which, in contrast to the above solution, the ink well is swivel-mounted on bearings, which are attached to a bar connected to the frame.

In the above prior art devices, it is relatively complicated to change the ink in the ink well, which is disadvantageously positioned for this purpose. In DE 42 24 775, the ink well is emptied by a blade that scrapes the ink over an uneven, sharply rising bottom surface into a container located on the upper edge of the ink well. It is thus difficult to empty the ink well in a way that completely avoids ink residues. It is also difficult to thoroughly wash the ink well and ink roller, because they are not readily accessible.

Similar problems arise in an ink container in the generally known form of a chamber blade arranged in swivelling fashion on a screen roller. When the chamber blade is swivelled away from the screen roller, the danger exists that residual ink will emerge. Cleaning is again difficult due to limited access.

SUMMARY OF THE INVENTION

It is an object of the present invention is to provide an inking apparatus for rotary printing machines wherein an ink container can be emptied in an operator-friendly fashion that avoids ink residues to the greatest possible extent.

It is a further object of the present invention to provide an inking apparatus for rotary printing machines wherein the ink container and an ink roller can be thoroughly cleaned while being well accessible.

These and other objects are attained by the present invention as follows, the swivelling movements of the ink container, combined with those of a holder that carries the ink roller, create favorable conditions for emptying the ink container as well as for cleaning and washing the container and roller. Specifically, the ink roller and ink container can both be swivelled into a position that frees the roller from the draining ink, so that when the ink container is subsequently swiveled away from the roller no ink emerges. In particular, a large area is created for emptying an ink container and for removing an auxiliary insert from the ink container. To achieve accessibility for washing, the ink container can be swivelled away from the roller, which itself has already been swivelled away from its operating position.

The present invention also permits an interruption of contact between the ink roller and a subordinated transfer roller, but maintains the operational connection of the ink roller. The ink roller can be driven in every swiveled position, as needed.

The ink roller, which interacts with the ink container in the form of a chamber blade, can be equipped with depressions for holding ink. It can also be embodied as a screen roller for a short inking apparatus, or as a regularly structured form roller for background printing, or as an irregularly structured form roller for general printing.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

In the drawings, wherein like reference numerals delineate similar elements throughout the several views.

DETAILED DESCRIPTION OF THE PRESENTLY PREFERRED EMBODIMENTS

Figure 1:
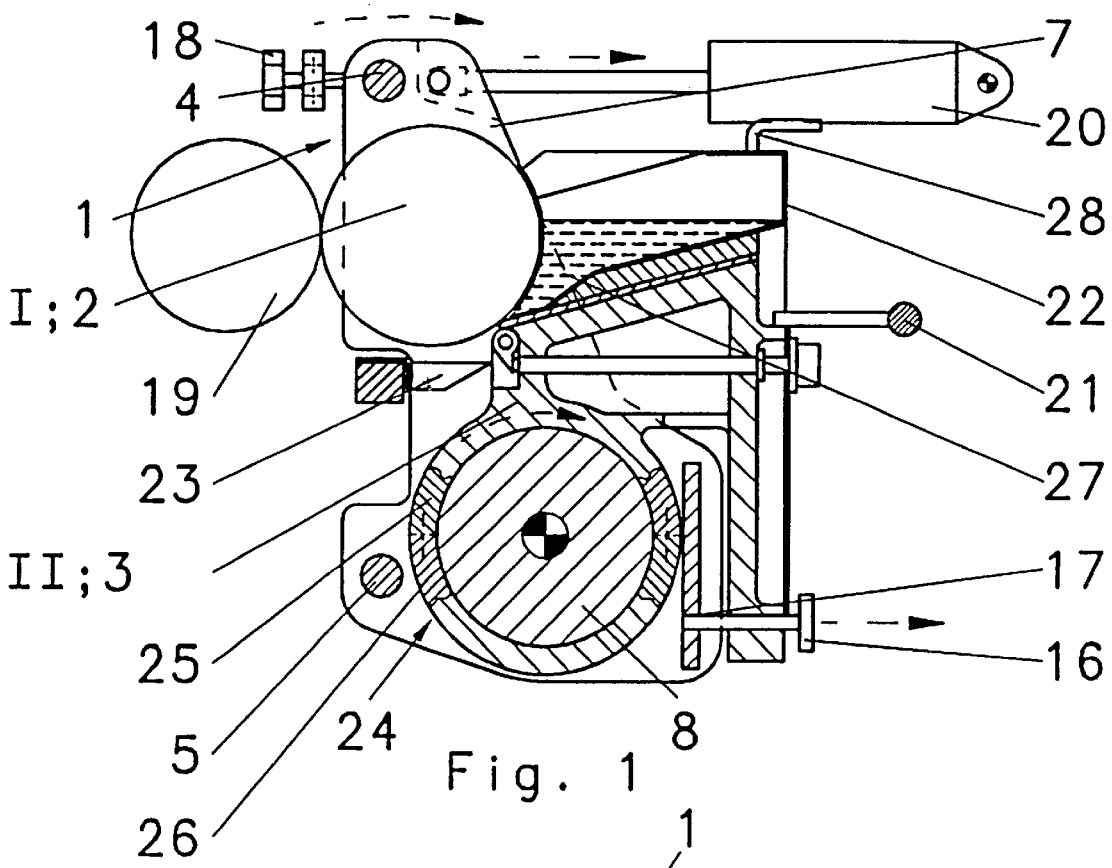
FIG. 1 is a side view of a first embodiment of the inking apparatus according to the invention in the operating position.
Figure 6:
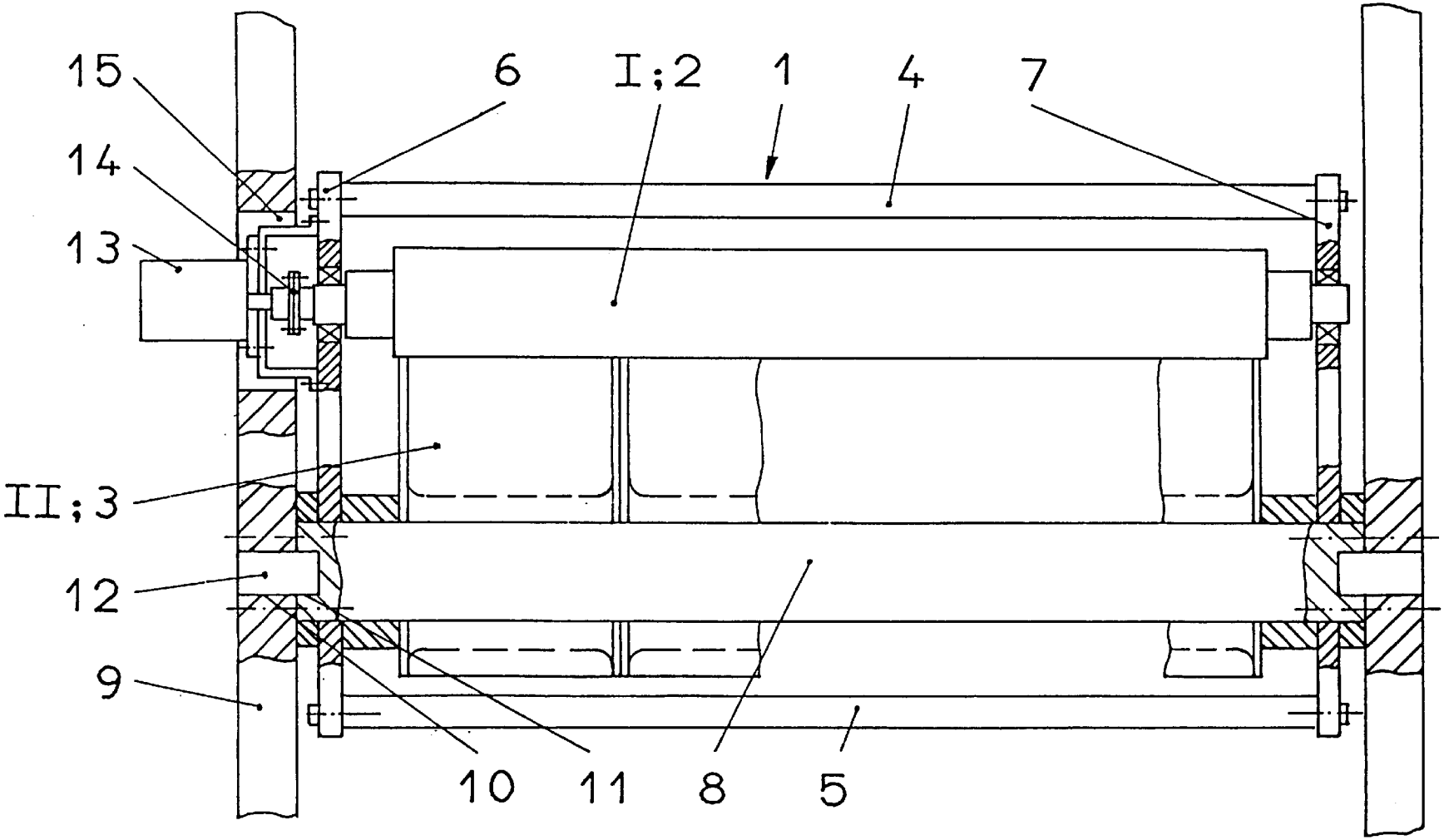
FIG. 6 is a front view of the inking device of FIG. 1 with function elements partially rotated into the plane of the drawing.

Referring to FIGS. 1 and 6, a drivable roller I in the form of an ink fountain roller 2 is rotatably mounted on a holder 1. An ink container II in the form of an ink fountain 3 (ink well) is swivelably connected to holder 1. In an operating position, shown in FIG. 1, ink fountain 3 is held against ink roller 2. Holder 1 includes two levers 6, 7, connected rigidly to each other by traverses 4, 5 (see FIG. 6). Holder 1 is mounted on an axle 8 with ink fountain 3 in such a way that holder 1 can be swivelled separately from ink fountain 3. Each end of axle 8, which is seated internally on a frame 9, has an axial adjustment boring 11, which is aligned with a similar adjustment boring 10 on frame 9. Seated in boring 11 is an adjustment bolt 12. Adjustment bolt 12 engages adjustment boring 10. The face of each axle 8 is thus threadably connected onto frame 9 (see FIG. 6).

A motor 13 is connected to lever 6 laterally and coaxially relative to ink fountain roller 2. The drive of motor 13 is connected to ink fountain roller 2 by a fixed coupling 14. Frame 9 is equipped for motor 13 with a recess 15 that permits swivelling of holder 1.

As FIG. 1 shows, the position of ink fountain 3 can be held constant relative to holder 1 and ink fountain roller 2 as holder 1 swivels about axle 8. For this purpose, a holding bolt 16 is axially movably connected in the housing of ink fountain 3, selectively engaging an aligned hole 17 of holder 1.

In the operating position, holder 1 rests on an adjustable stop 18. Adjustable stop 18 limits the contact of ink fountain roller 2 with a subordinated transfer roller 19.

Figure 3:
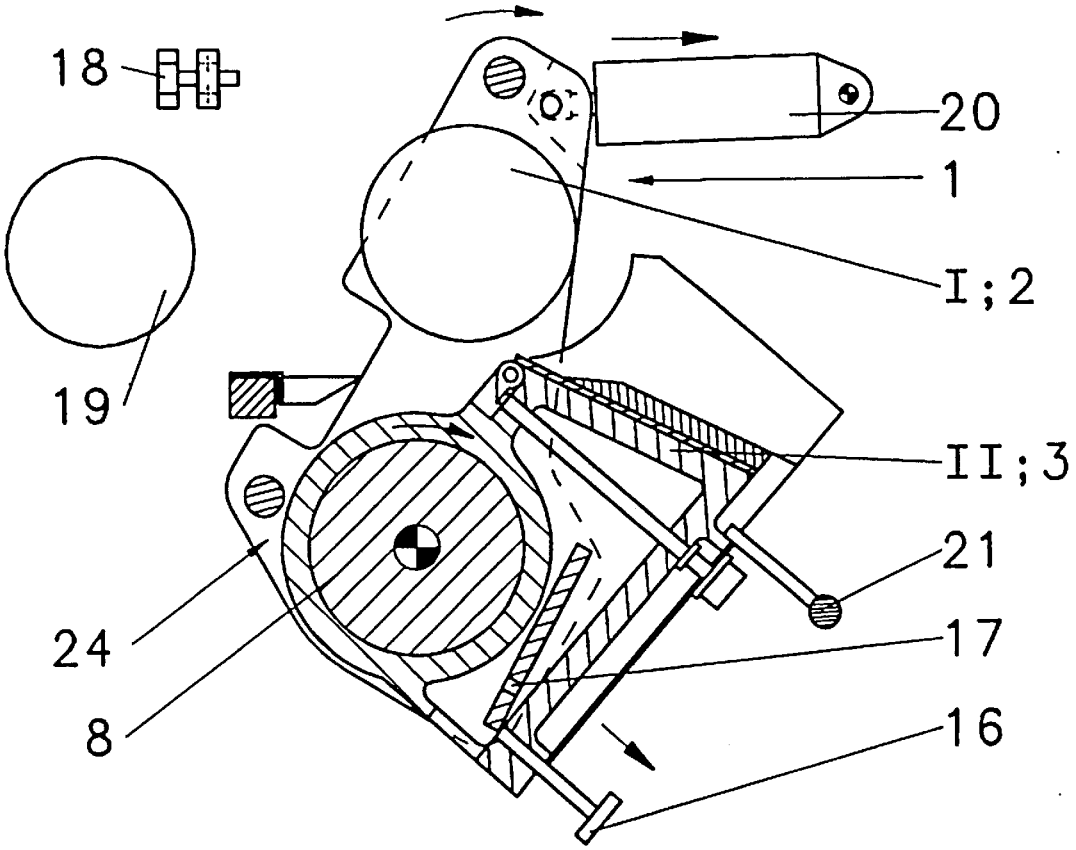
FIG. 3 shows the inking apparatus as in FIG. 2, but with the ink well also swivelled away from the ink roller.

Referring to FIG. 3, holder 1 and ink fountain 3 are swivelled jointly by operation of a pressure-operated working cylinder 20, which acts upon holder 1 and is linked to frame 9. However, when holding bolt 16 is released from aligned hole 17, ink fountain 3 is swivelled separately by hand, with the help of an attached handle 21. Advantageously, the swivelling movement of ink fountain 3 is limited relative to holder 1 by a stop (not shown) or another type of arresting device.

To facilitate ink changes, ink fountain 3 is equipped with an exchangeable ink fountain insert 22. Furthermore, an exchangeable drip basin 23 extends to the axial gap between ink fountain roller 2 and ink fountain 3 when holder 1 is in the operation position. Exchangeable drip basin 23 is arranged below ink fountain roller 2 and attached to frame 9.

Referring now to FIG. 6, four independently swivelling ink fountains 3, each of which is one-fourth of the web width (width of ink roller 2), are arranged next to one another. Alternatively, these can be exchanged for two ink fountains of one-half web width or one ink fountain of full web width. In a variant with a slightly modified ink fountain housing (shown in FIG. 1 by a dotted line), the bearing 24 of ink fountain 3 can have multiple parts, i.e., can be composed of bearing shells 25, 26 that can be screwed together radially on axle 8. This facilitates assembly of ink fountain 3 and permits the rapid exchange of ink fountains of different widths.

Figure 2:
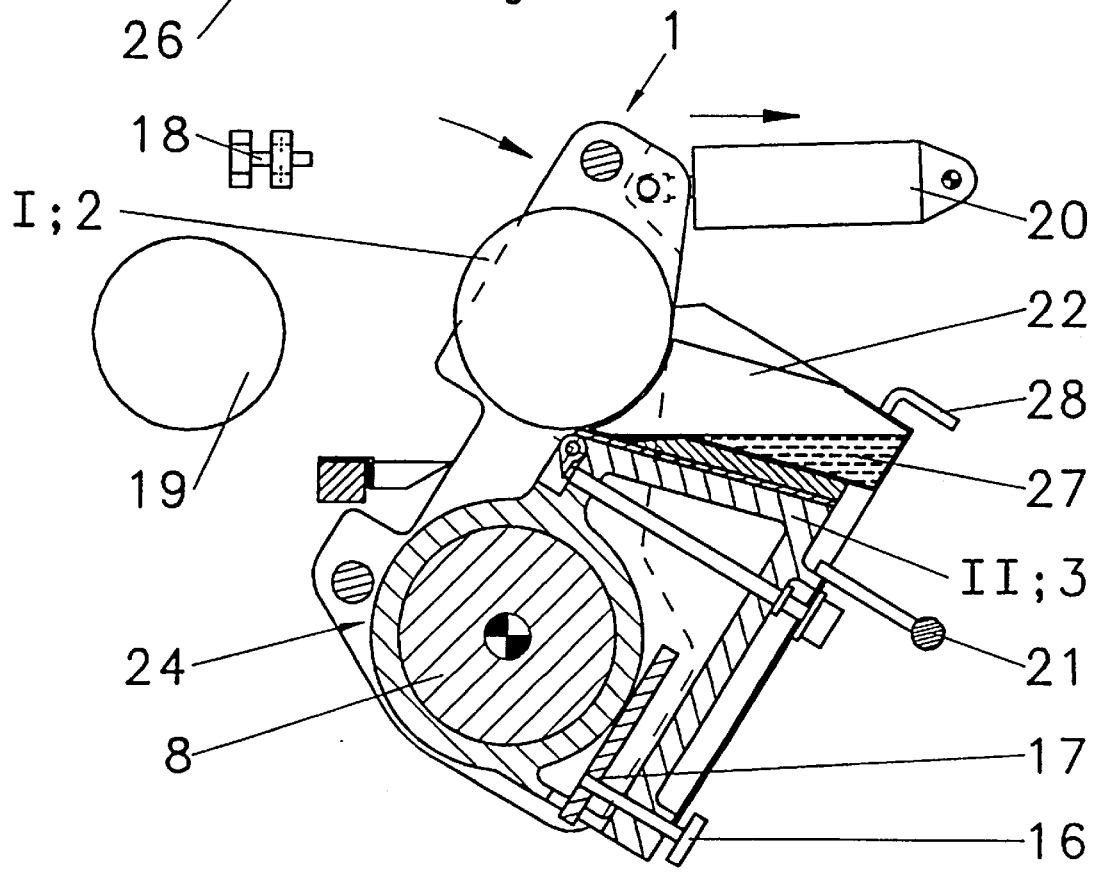
FIG. 2 shows the inking apparatus as in FIG. 1, in the ink changing position.

Referring to FIG. 2, holder 1 and ink fountain 3 (which is held relative to the holder), are swivelled into an ink changing position by a working cylinder 20. In this position, ink 27 flows completely away from ink fountain roller 2 and into the back area of ink fountain insert 22. Ink fountain insert 22 can thus be removed, by a handle 28, with no danger that ink will emerge from the side of ink fountain insert 22 which is open toward ink fountain roller 2.

FIG. 3 shows an ink fountain 3 swivelled away from the ink fountain roller 2 after holding bolt 16 has been released from hole 17 of holder 1. The entire device is therefore optimally accessible for cleaning.

Figure 4:
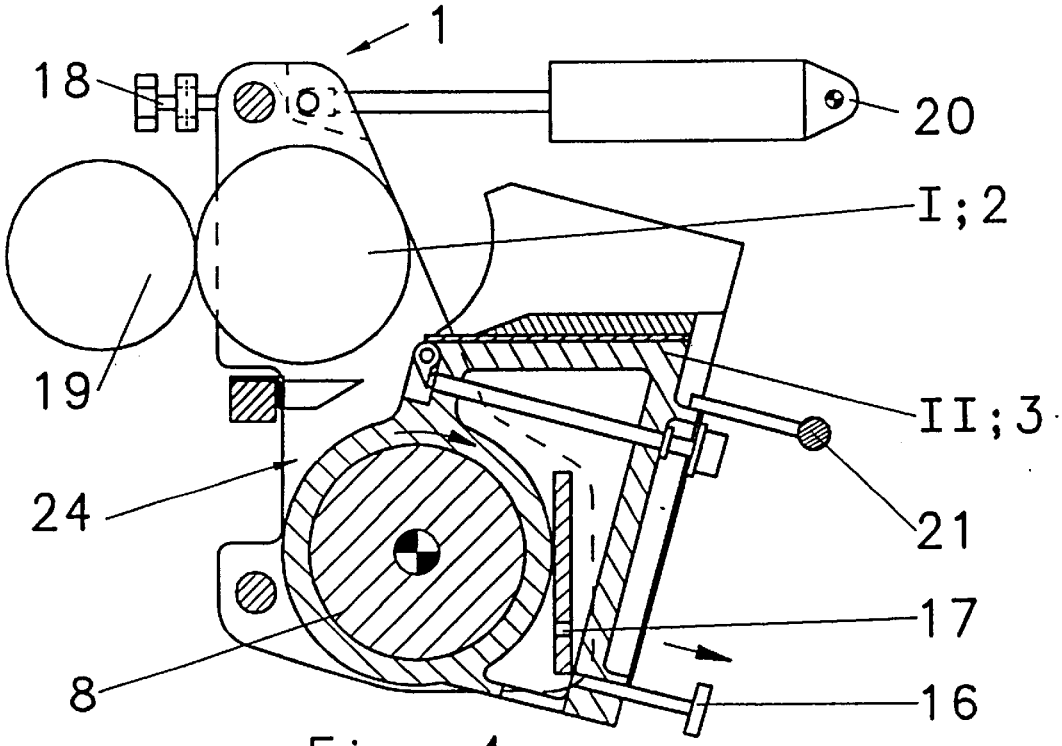
FIG. 4 shows the inking apparatus of FIG. 1 with the ink roller in the operating position and the ink well swivelled away from the roller for cleaning.

FIG. 4 shows holder 1 with ink fountain roller 2 contacting transfer roller 19. In this position, ink fountain 3 is also swivelable away from holder 1 and roller 2 for cleaning.

Figure 5:
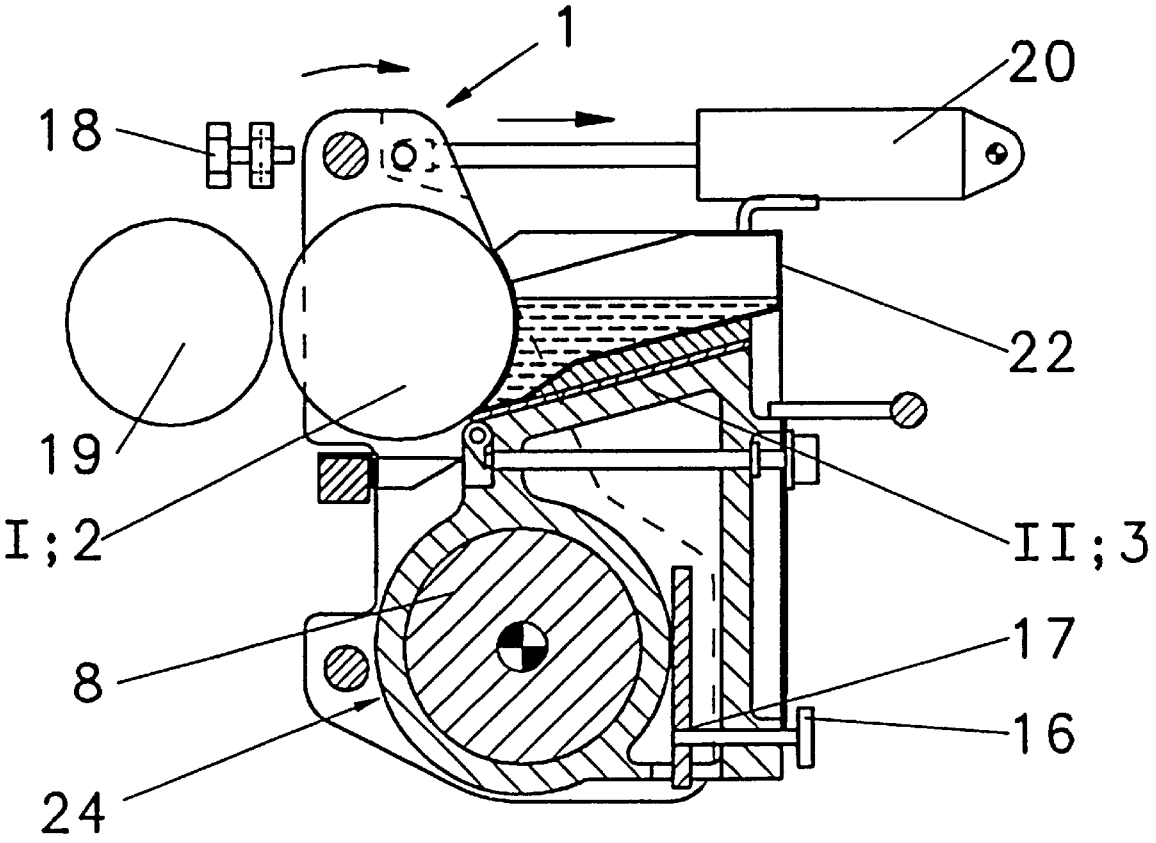
FIG. 5 shows the inking apparatus as in FIG. 1 in a position moved away from a subordinated transfer roller.

FIG. 5 shows holder 1 moved away from transfer roller 19. Contact is thus interrupted between ink fountain roller 2 and transfer roller 19, but the apparatus is otherwise ready for operation.

Figure 7:
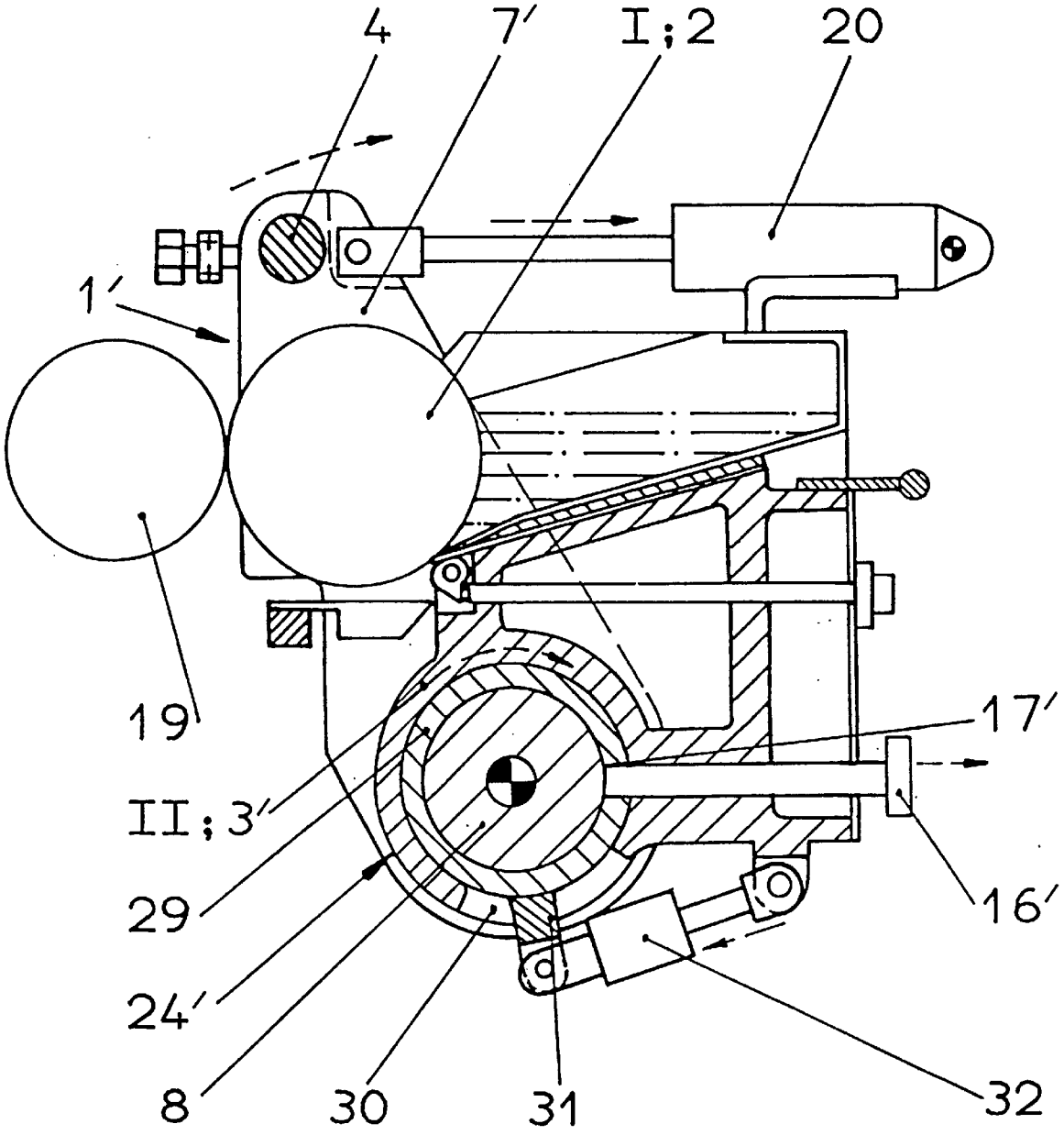
FIG. 7 shows another embodiment of the inking apparatus of the present invention with a tube serving for the bearing and as a bar for the holder.
Figure 8:
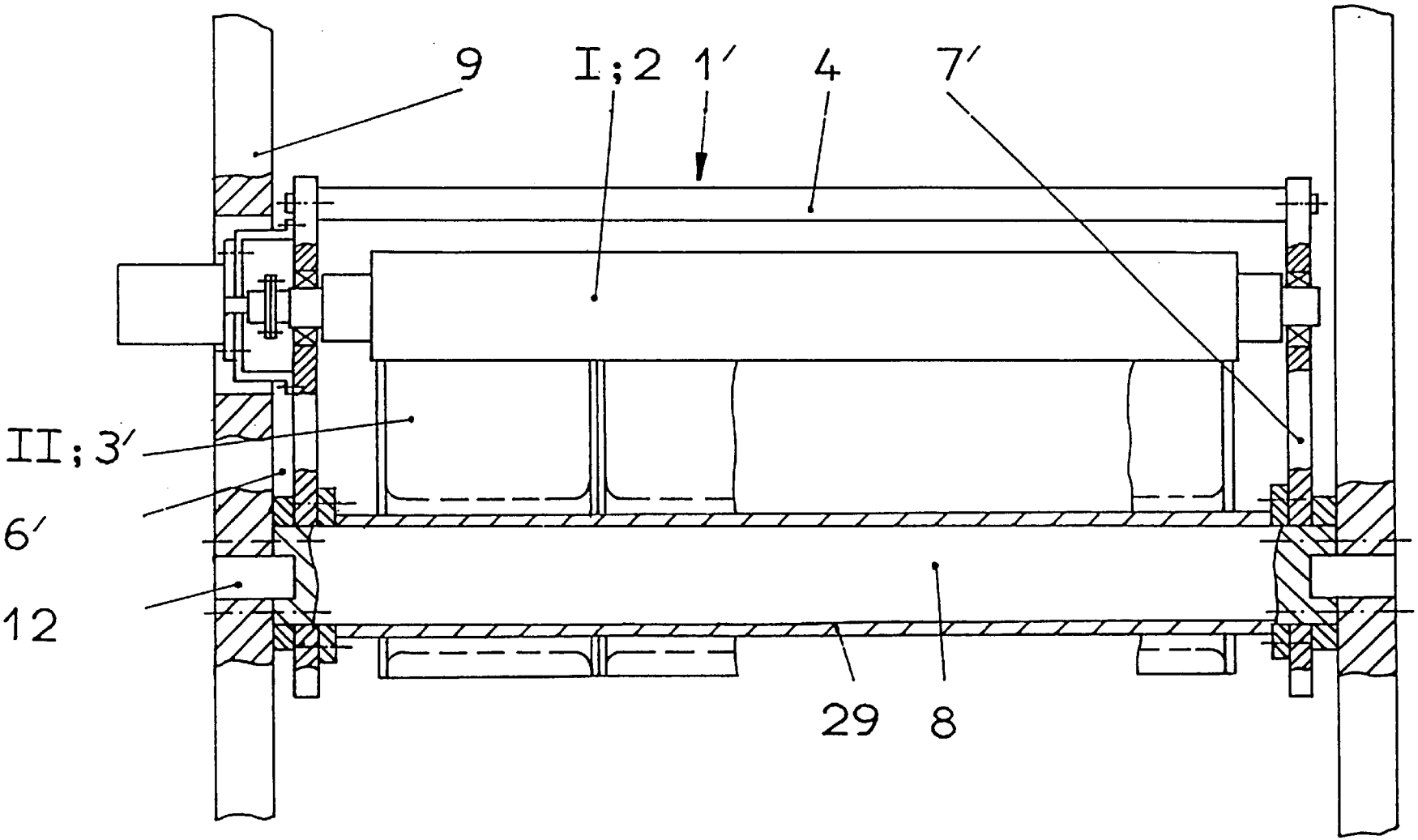
FIG. 8 is a front view of the inking apparatus of FIG. 7 with function elements partially rotated into the plane of the drawing.

FIGS. 7 and 8 show an apparatus modified from FIGS. 1 and 6 in that the holder 1' has been effectively reinforced by a tube 29 in the form of a bar. Tube 29 securely connects the two levers 6', 7'. Tube 29 is mounted on axle 8 and carries ink fountain 3' in a swivelling manner. In this embodiment, arresting bolt 16' of ink fountain 3' engages into hole 17' of tube 29.

In FIG. 7, ink fountain 3' is swivelable by a working cylinder 32 (an actuator), which is linked, on the one hand, to ink fountain 3' and, on the other, to a lever 31, which is attached to tube 29. Lever 31 radially penetrates bearing 24' of ink fountain 3' in a recess 30 that permits a swivelling movement.

Figure 9:
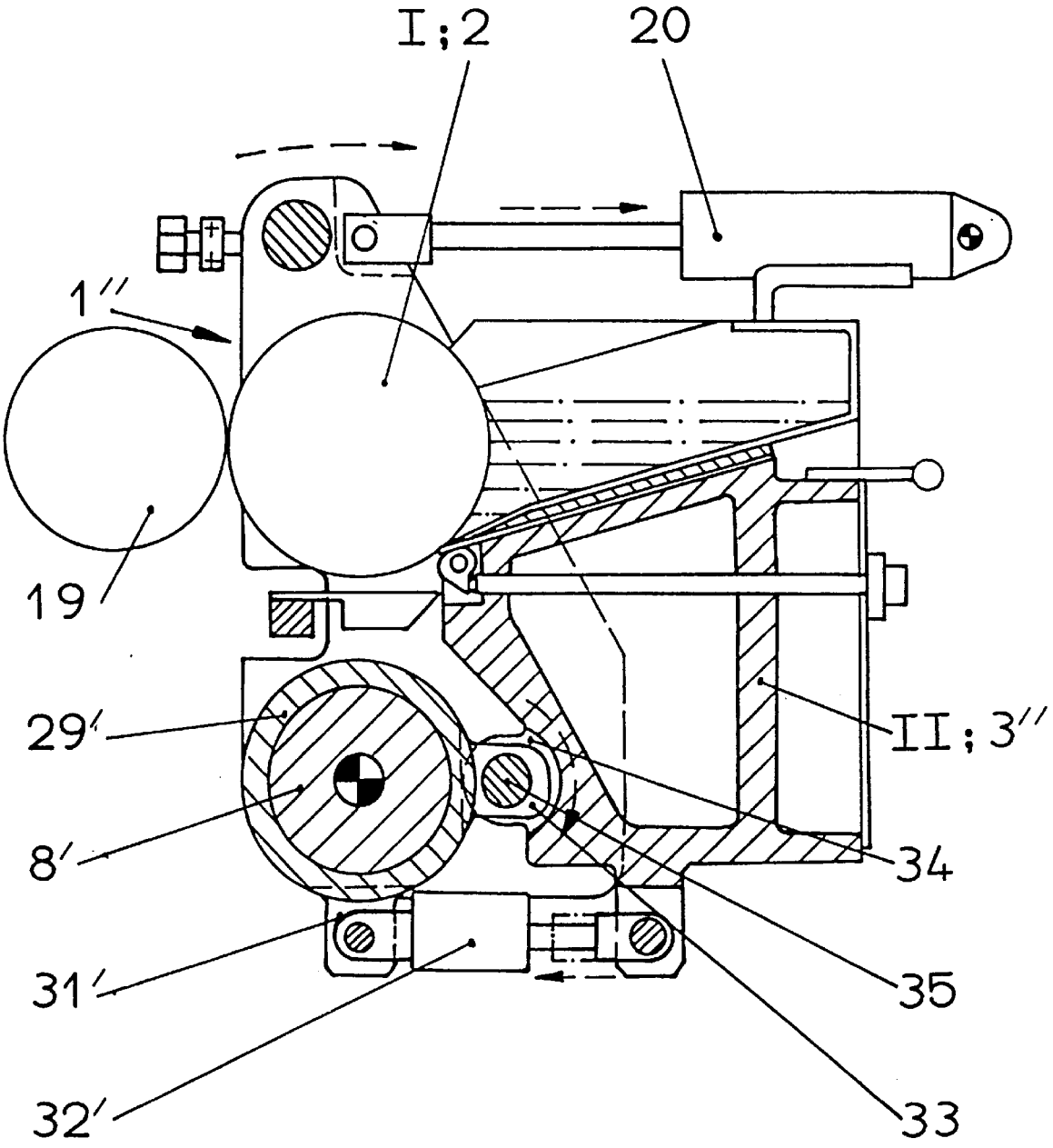
FIG. 9 shows a further embodiment of the present invention with an ink well mounted in the holder in a manner axis-parallel and offset to the bearing of the holder.

FIG. 9 shows an ink fountain 3" mounted on a bearing bolt 35 which is parallel and offset relative to an axle 8' of a holder 1". Reciprocally overlapping bearing levers 33, 34, each of which is penetrated parallel to the axle 8' of holder 1" by a bearing bolt 35, are attached to a tube 29' and ink fountain 3", respectively.

Figure 10:
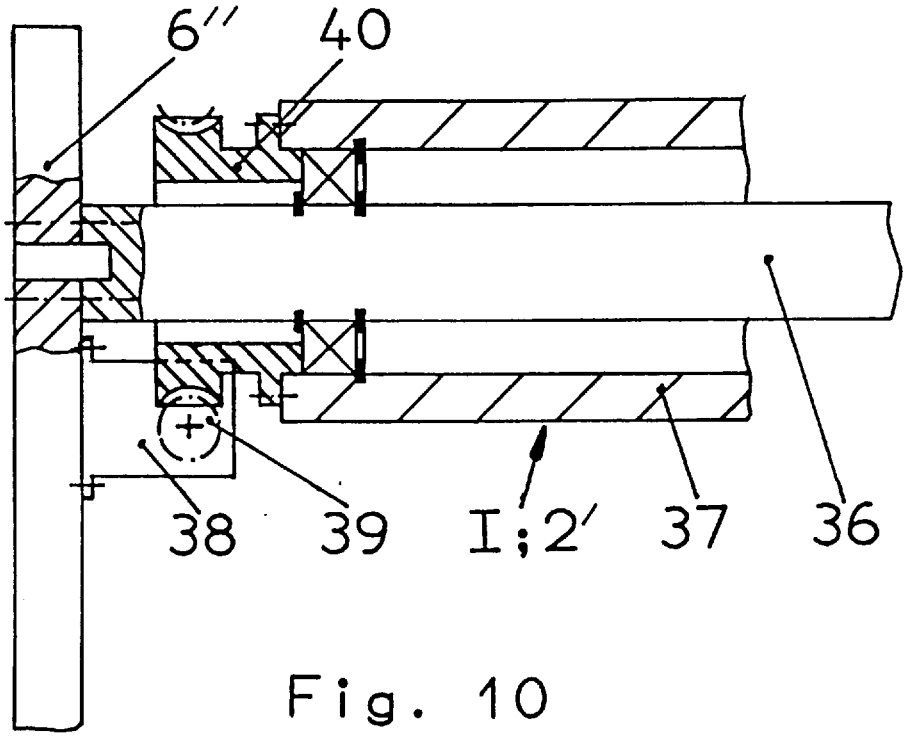
FIG. 10 shows a front view as in FIGS. 6 and 8 with bearing and drive of the ink well roller connected to a worm drive.

FIG. 10 shows a drive variant for ink fountain roller 2'. Ink fountain roller 2' is equipped with a fixed axle 36 and a roller shell 37 mounted rotatably on the axle 36. A motor 38, secured laterally to the lever 6", drives a worm 39. Worm 39 is meshed with a worm gear 40 attached coaxially to roller shell 37.

Figure 11:
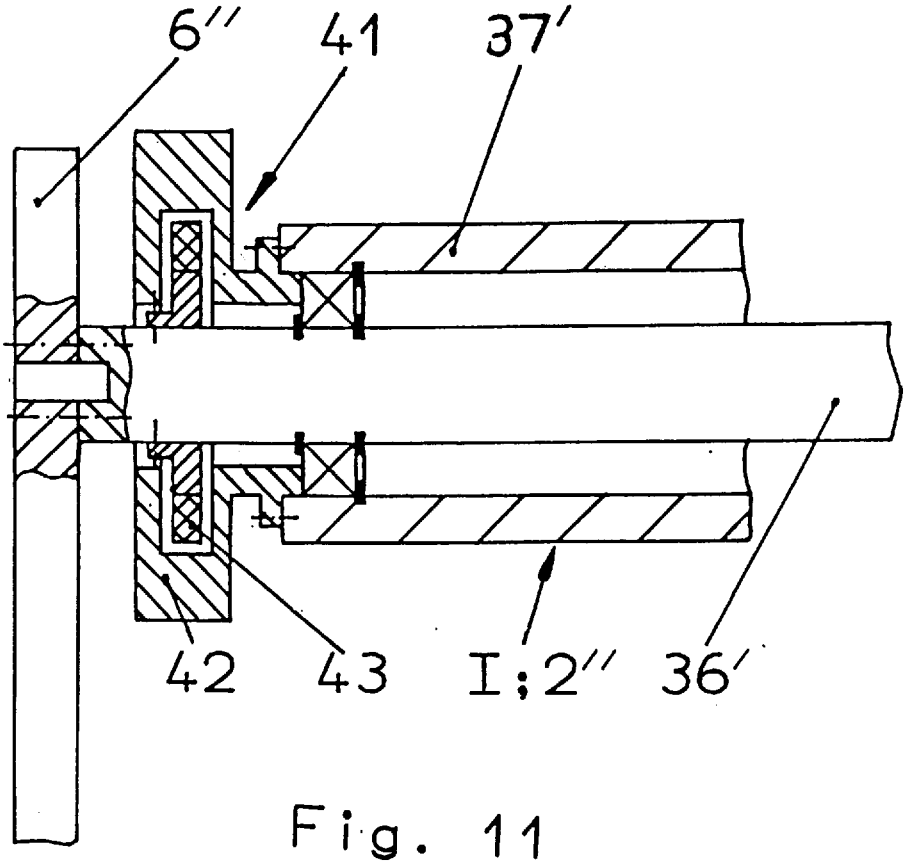
FIG. 11 shows a further embodiment of the drive of ink well roller with a disk armature motor.

In FIG. 11, an ink fountain roller 2" similar to that in FIG. 10 is driven by a disk armature motor 41, whose rotor 42 is attached coaxially to a roller shell 37' and whose stator 43 is seated on an axle 36'.

The drawings do not show the drive for the ink fountain rollers 2; 2'; 2". In this drive, a driving gear drivable in any desired manner is rotatably mounted on axle 8 or tube 29; 29' coaxial to the swivel axle of holder 1; 1'; 1". The driving gear is connected via a drive mechanism to ink fountain roller 2; 2'; 2". The driving gear can be embodied as a toothed disk that drives, by positive-locking traction means in the form of a chain or toothed belts, a coaxial toothed disk that is securely connected to ink fountain roller 2 or its roller shell 37; 37'.

It is also conceivable to replace the toothed disks by spur gears that engage each other by at least one intermediate spur gear which is mounted in the holder 1; 1'; 1".

Figure 12:
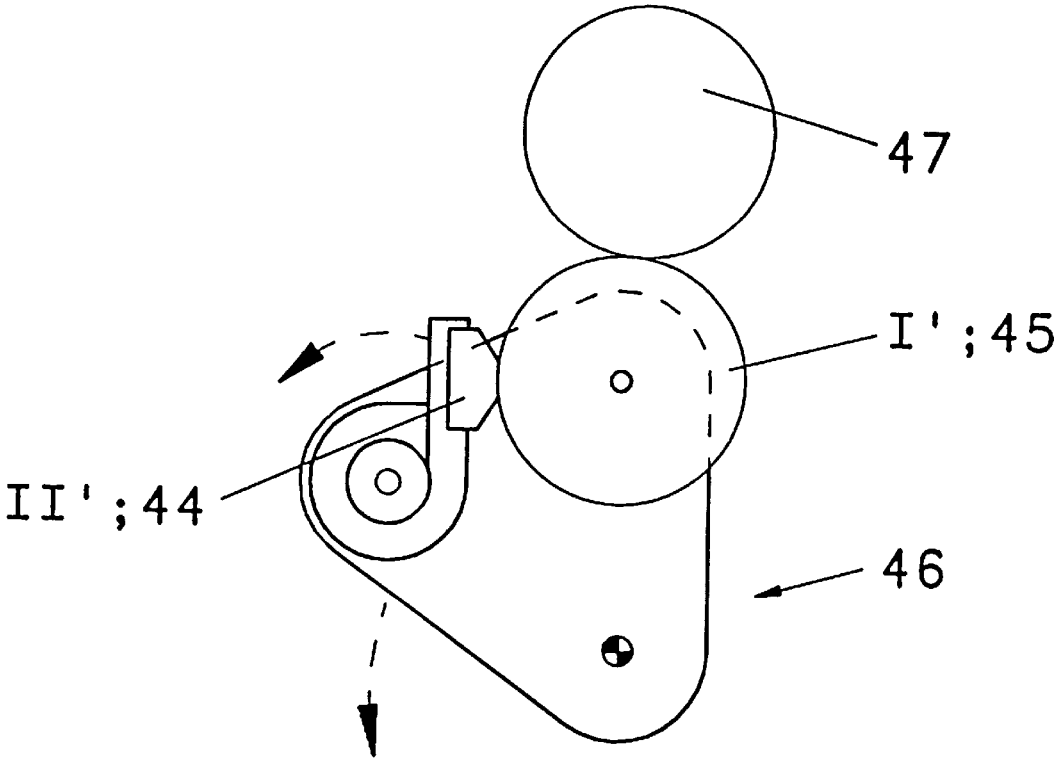
FIG. 12 is a side view of another embodiment of the inking apparatus of the present invention, with a swivelling ink container in the form of a chamber blade and a roller in the form of a screen roller. The swivel axles of the chamber blade and the holder of the screen roller are arranged in an axis-parallel and offset manner.
Figure 13:
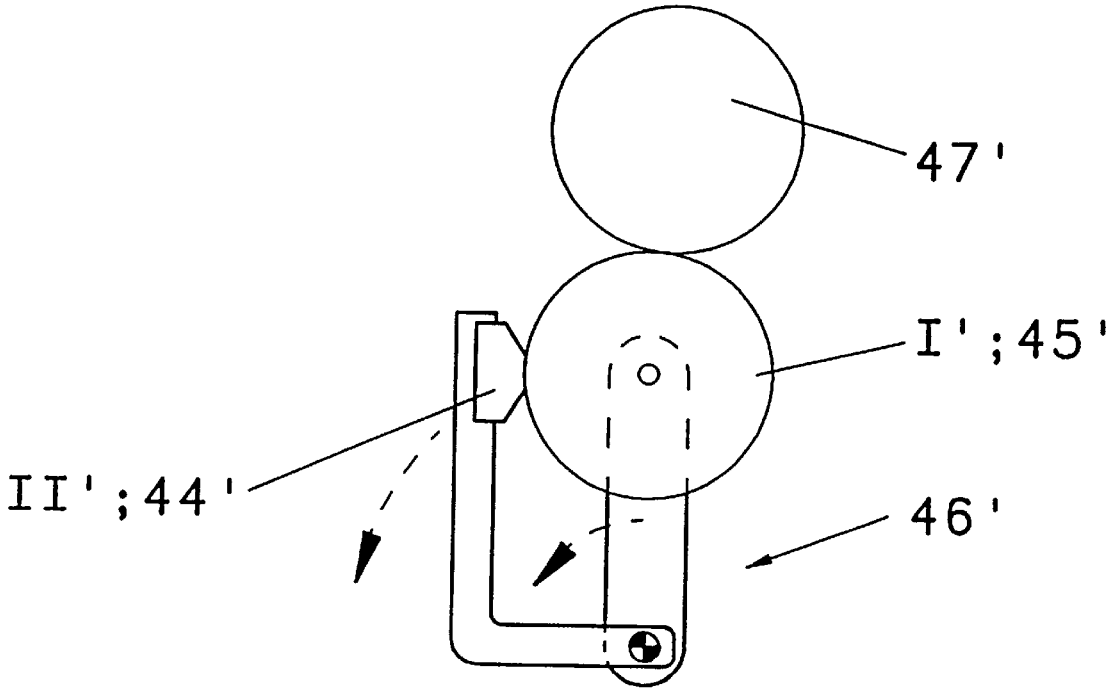
FIG. 13 is a side view of yet another embodiment of the inking apparatus as in FIG. 12, with swivel axles arranged coaxially.

In schematic fashion, FIGS. 12 and 13 show a chamber blade 44; 44' as ink container II' and a screen roller 45; 45' as roller I'. Like ink fountain 3" in FIG. 9, chamber blade 44 in FIG. 12 is swivel-mounted in holder 46 offset and parallel to the swivel axle of holder 46, which carries the screen roller 45. Like ink fountain 3; 3' in FIGS. 1 through 8, chamber blade 44' in FIG. 13 is swivel-mounted coaxially to the swivel axle of holder 46', which carries screen roller 45'.

The identically structured screen rollers 45; 45', equipped with depressions to hold ink, are particularly suitable for short inking apparatus that work with chamber blades and screen rollers. Screen roller 45; 45' inks a transfer roller 47; 47' of short inking apparatus.

Instead of screen roller 45; 45', it is possible to provide a form roller with depressions to hold the ink, which inks a transfer roller in the indirect printing method. The form roller can be regularly structured for background printing, or irregularly structured for general printing.

With respect to the holder, bearing and drive of the ink fountain roller and the bearing of the ink fountain, the solution variants described and shown in FIGS. 1 to 11, particularly for an apparatus comprising an ink fountain 3; 3'; 3" and an ink fountain roller 2; 2'; 2", are transferrable to the chamber blade 44; 44' and the screen roller 45; 45' in FIGS. 11 and 12.

The invention is not limited by the embodiments described above which are presented as examples only but can be modified in various ways within the scope of protection defined by the appended patent claims.

We claim:

1. An inking apparatus for rotary printing machines, comprising:

a frame;

a holder swivelably connected to said frame about an axle;

an ink roller rotatably connected to said holder;

said holder being swivelable between an operating position of said ink roller and a cleaning position, whereat access is provided to said ink roller; and an ink fountain pivotally connected to said holder, such that said ink fountain pivots relative to said holder, independent from a pivoting of said holder about said axle.

2. The inking apparatus of claim 1, wherein said ink fountain is swivelably mounted coaxially to said axle of said holder.

3. The inking apparatus of claim 1, wherein said ink fountain is swivelably mounted to said holder, offset and parallel to said axle of said holder.

4. The inking apparatus of claim 1, wherein said holder and said ink fountain are selectively fixedly connectable such that a constant position of said ink fountain with respect to said holder is maintained while said holder is swiveled between said operating position and said ink changing position when said holder and said ink fountain are fixedly connected; and ink in said ink fountain flows away from said ink roller to a back area of said ink fountain when said holder and said ink fountain are in said ink changing position.

5. The inking apparatus of claim 1, wherein said holder further includes:

a pair of levers mounted on either side of said ink roller, and traverse bars for rigidly connecting said levers to each other;

said levers swivelably mounted on said axle; and said levers supporting said ink roller.

6. The inking apparatus of claim 1, further including:

a motor having a motor body and a drive shaft;

said drive shaft being coaxially in drive connection with said ink roller; and said motor body being connected to said holder.

7. The inking apparatus of claim 1, further including:

a motor;

a worm gear mounted coaxially to said ink roller and securely connected thereto;

a worm meshed with said worm gear and driveably connected to said motor.

8. The inking apparatus of claim 1, further including:

a disk armature motor having a rotor and a stator;

said stator being seated on a fixed axle of said ink roller;

said rotor being fixedly connected to a roller shell, which is rotatably mounted on said axle of said ink roller.

9. The inking apparatus of claim 1, further including:

a drive mounted on said holder having a driving gear connected to said ink roller; and said driving gear being rotatably mounted coaxially to said axle of said holder.

10. The inking apparatus of claim 9, wherein said driving gear is a first toothed disk; and further comprising:

a second toothed disk connected coaxially with said ink roller; and said driving gear driving said ink roller using one of a chain and a toothed belt to connect said first toothed disk and said second toothed disk.

11. The inking apparatus of claim 9, wherein said drive includes a spur gear mechanism having at least one intermediate toothed gear mounted in said holder.

12. The inking apparatus of claim 5, wherein said axle and said ink fountain have an adjustment hole, through which a common adjustment bolt is insertable for selectively connecting said ink fountain to said holder.

13. The inking apparatus of claim 5, further including:

a tube coaxially mounted over said axle;

said tube fixedly connecting said levers, thereby acting as a traverse bar between said levers; and said ink fountain being swivelably mounted about said tube.

14. The inking apparatus as in claim 13, further including:

reciprocally overlapping bearing levers being attached to said ink fountain and said tube, respectively;

a bearing bolt inserted through said reciprocally overlapping bearing levers; and said bearing bolt being offset from and parallel to said axle of said holder such that said ink fountain is swivelable about said bearing bolt with respect to said holder.

15. The inking apparatus of claim 5, wherein said ink fountain is connected about said axle of said holder with a multi-part bearing including a pair of bearing shells that are radially connectable using detachable connection elements.

16. The inking apparatus of claim 1, wherein said ink fountain is swivelable relative to said holder at any position of said holder.

17. The inking apparatus of claim 16, wherein said ink fountain includes:

a holding bolt slidably mounted within said ink fountain;

said holding bolt being engageable with a hole in said holder when said ink fountain contacts said ink roller such that said ink fountain can be held in a constant position with respect to said ink roller when said holding bolt engages said hole in said holder.

18. The inking apparatus of claim 1, further including an actuator connected between said holder and said frame for swivelling said holder between said operating position and said ink changing position.

19. The inking apparatus of claim 1, further including an actuator connected between said ink fountain and said holder such that said ink fountain is swivelable relative to said ink roller by actuation of said actuator.

20. The inking apparatus of claim 1, wherein said ink fountain includes a plurality of smaller ink fountains in one-half or one-quarter widths arranged side by side in said inking apparatus, wherein each one of said plurality of smaller ink fountains is separately swivelable relative to said ink roller.

21. The inking apparatus of claim 1, wherein said ink roller is an ink ductor roller.

22. The inking apparatus of claim 1, wherein said ink fountain includes an exchangeable ink fountain insert.

23. The inking apparatus of claim 1, wherein said ink roller includes depressions that hold said ink and said ink fountain operates as a chamber blade against said ink roller.

24. The inking apparatus of claim 23, wherein said ink roller having said depressions is a screen roller.

25. The inking apparatus of claim 23, wherein said ink roller having said depressions is a form roller.

* * * * *